US011028707B2

(12) United States Patent
Johansson

(10) Patent No.: US 11,028,707 B2
(45) Date of Patent: Jun. 8, 2021

(54) ZONED SURFACE ROUGHNESS

(71) Applicant: GKN Aerospace Sweden AB, Trollhättan (SE)

(72) Inventor: Peter Johansson, Trollhättan (SE)

(73) Assignee: GKN Aerospace Sweden AB, Trollhättan (SE)

( * ) Notice: Subject to any disclaimer, the term of this patent is extended or adjusted under 35 U.S.C. 154(b) by 54 days.

(21) Appl. No.: 16/470,284

(22) PCT Filed: Jan. 19, 2018

(86) PCT No.: PCT/EP2018/051341
§ 371 (c)(1),
(2) Date: Jun. 17, 2019

(87) PCT Pub. No.: WO2018/134367
PCT Pub. Date: Jul. 26, 2018

(65) Prior Publication Data

US 2020/0011189 A1 Jan. 9, 2020

(30) Foreign Application Priority Data

Jan. 19, 2017 (GB) ..... 1700954

(51) Int. Cl.

| | |
|---|---|
| ***F01D 25/24*** | (2006.01) |
| ***F01D 9/04*** | (2006.01) |
| ***F04D 29/54*** | (2006.01) |
| ***F01D 9/06*** | (2006.01) |
| *F04D 29/66* | (2006.01) |

(52) U.S. Cl.
CPC ..... *F01D 9/04* (2013.01); *F01D 9/06* (2013.01); *F04D 29/547* (2013.01); *F04D 29/667* (2013.01); *F05D 2240/12* (2013.01); *F05D 2250/621* (2013.01); *F05D 2300/516* (2013.01)

(58) Field of Classification Search
CPC ..... F01D 9/06; F01D 25/24; F04D 29/545; F04D 29/547; F05D 2300/516
See application file for complete search history.

(56) References Cited

U.S. PATENT DOCUMENTS

| | | | | |
|---|---|---|---|---|
| 7,610,179 | B2 * | 10/2009 | Florea | F01D 9/023 703/1 |
| 8,500,399 | B2 * | 8/2013 | Fulayter | F01D 17/141 415/182.1 |
| 2008/0138197 | A1 * | 6/2008 | Green | F01D 9/023 415/182.1 |
| 2010/0172747 | A1 | 7/2010 | Clark et al. | |

(Continued)

FOREIGN PATENT DOCUMENTS

| | | | |
|---|---|---|---|
| DE | 102014219821 | A1 | 3/2016 |
| WO | 2016001602 | A1 | 1/2016 |

OTHER PUBLICATIONS

UKIPO Office Action for Application No. GB1700954.9 dated Jun. 25, 2019 (5 pages).

(Continued)

*Primary Examiner* — Ninh H. Nguyen
(74) *Attorney, Agent, or Firm* — Bejin Bieneman PLC

(57) ABSTRACT

The invention concerns a transition duct for a multi-stage compressor of a gas turbine engine. Regions of the inner surface of the duct are provided with a predetermined and dissimilar surface roughness to optimise gas flow efficiency within the duct.

14 Claims, 3 Drawing Sheets

(56) References Cited

U.S. PATENT DOCUMENTS

| | | | | |
|---|---|---|---|---|
| 2019/0024586 | A1* | 1/2019 | Mardjono | F04D 19/02 |
| 2019/0178098 | A1* | 6/2019 | Wunderer | F02C 6/08 |

OTHER PUBLICATIONS

UKIPO Office Action for Application No. GB1700954.9 dated Oct. 28, 2019 (2 pages).
International Search Report and Written Opinion for PCT/EP2018/051341 dated Apr. 16, 2018 (15 pages).

* cited by examiner

ZONED SURFACE ROUGHNESS

CROSS-REFERENCE TO RELATED APPLICATIONS

This application is a national stage of, and claims priority to, Patent Cooperation Treaty Application No. PCT/EP2018/051341, filed on Jan. 19, 2018, which application claims priority to Great Britain Application No. GB 1700954.9, filed on Jan. 19, 2017, which applications are hereby incorporated herein by reference in their entireties.

BACKGROUND

A typical gas turbine engine comprises a pair of compressors, namely a first upstream low pressure compressor and a second, downstream, high pressure compressor. The pair of compressors compress air entering the engine in two-stages before the compressed gas is communicated into the combustors where fuel is introduced and the mixture ignited. The operation of a gas turbine engine is well known to a person skilled in the art.

The invention is concerned with the transition duct which communicates air between the low and high pressure compressors. The low and high pressure compressors are concentric with the central rotational axis of the gas turbine engine. The low pressure compressor has a larger radius than the high pressure compressor for efficiency reasons. For example, a smaller diameter high pressure compressor allows for weight savings within the engine and a more compact design.

This difference in radius necessitates a duct or channel that can communicate air from the outlet of the low pressure compressor to the inlet of the high pressure compressor. Because each compressor is cylindrical (and rotates about the central axis of the engine) the duct (or channel) is in the form of a ring shaped channel concentric with the axis of the engine and having a tapering diameter between the inlet at the upstream end and the outlet at the downstream end.

Pressure losses in the engine severely influence the efficiency of a gas turbine engine and so it is desirable to minimise any pressure loss. Pressure losses can occur for a range of reasons including surface friction, geometry and lead to a potential for separation of the flowing air from the surface of the channels within the engine.

The solution to reduce pressure losses between the low pressure and high pressure compressors is to machine the duct surfaces to a very high surface finish. The surfaces may even be polished to prevent any disruption to the air flowing through the duct. This finishing can often be difficult and expensive to achieve because it is the inner surfaces of the duct which require machining. This complexity is somewhat negated by the fact that conventional engines are relatively long meaning the taper on the duct is not severe allowing more convenient access for machine tools inside the duct.

However, there is a general desire in the industry to reduce the overall length of gas turbine engines, in effect compressing all of the components in an axial direction. In respect of the duct between the low and high pressure compressors this can significantly reduce the axial length over which the compressed air must be translated from the large diameter to the smaller diameter of the high pressure compressor inlet. In fact this necessitates a sinusoidal or S shape of the duct.

The severity of the geometry of the duct directly influences the machining complexity and cost. The more extreme the geometry of the duct the more difficult it is to machine to the desired surface finishing required to achieve the expected efficiencies of modern engines. These are some of the difficulties gas turbine manufacturers currently face.

SUMMARY OF THE INVENTION

The present inventor has established a surprising alternative approach to machining the ducts described above which greatly improves the efficient communication of compressed air between the compressors, reduces pressure losses whilst also limiting expensive manufacturing costs. The present disclosure is concerned with an improved gas flow arrangement between multi-stage compressors. Specifically, but not exclusively, the disclosure is concerned with the gas flow between multi-stage compressors in a gas turbine engine.

Aspects of the invention are set out in the accompanying claims.

Viewed from a first aspect, described herein there is provided a multi-stage compressor comprising a first and second compressor coaxially located with respect to a central axis of a turbine, wherein an outlet of the first compressor is in fluid communication with an inlet of the second compressor through a duct, the duct defining a channel for gas flow and comprising an inner gas facing wall and an opposing outer gas facing wall defining the inner surfaces of the channel, and wherein regions of the inner surfaces of the channel have a predetermined and dissimilar surface roughness.

Thus, an unconventional duct arrangement is provided which is contrary to conventional designs in which ducts are provided with highly polished surfaces with a view to minimising pressure and other efficiency losses.

A major source of pressure loss in ducts of this type (also known in the art as core flow transition ducts) is rough surfaces that cause large friction losses. Specifically, the inner surfaces of the duct i.e. the surfaces which contain the gas and which define the ducts gas flow channel can cause major pressure losses.

Customer requirements are often expressed in terms of a maximum surface roughness. In order to meet these requirements, the manufacturing process often needs to include polishing or even super polishing to achieve a sufficiently smooth surface. This is difficult to achieve in practice since the flow path is s-shaped axially and often narrow in terms of radial height. The curved flow path dictates a polishing set-up that is highly flexible and sufficiently small so that it can be traversed through the flow path. Today it is often not possible to access all areas taking a single grip of the product. This in turn leads to a long operation time since the product may need to be rotated and machined from various positions. This substantially increases costs.

It is likely that this problem will prevail since there is a constant focus on reducing pressure loss in all components to reduce overall fuel consumption.

The present subject matter also allows for a reduction in weight by decreasing the duct axial length (or increase performance by increasing the radial offset for a given length). This has previously been impossible, partly due to the risk of flow separation with such aggressive duct designs.

At least one region of the inner surface of the channel against which flowing gas impinges may be provided with a predetermined surface roughness which is lower than regions of the inner surfaces against which flow gas does not impinge. As gas (air) enters the duct it impinges (impacts) on the inner surfaces of the duct where the duct is causing the gas to change direction. These regions may have a lower surface roughness to minimise friction which may be caused as the gas contacts the inner wall of the duct at these locations.

Conversely, regions of the inner surfaces which in use experience lower gas pressure may advantageously be provided with a predetermined surface roughness which is higher than the remaining inner surfaces of the channel. Regions of lower pressure are the regions of the duct which are diametrically opposite to the regions of high pressure. Specifically, referring to FIG. 2 (discussed in more detail below) a region of high pressure occurs due to the impact of the gas at region C and an opposing region E experiences a lower pressure. Advantageously, increasing the surface roughness at region E prevents separation of the gas flow form the surface of the duct at this region. This is described in more detail below.

The duct is in the form of a ring which, in use, is coaxially located with respect to a central axis of the compressor. The duct tapers from a first maximum radius measured from the central axis of the compressor to a second smaller radius measured from the central axis of the compressor. The first and second radii advantageously correspond to the radius of the outlet and inlet of the first and second compressors to allow for gas communication between the two through the duct.

The duct is in the form of a ring or annulus which, in use, is coaxial with the central axis of the compressor, the outer perimeter of the ring or annulus having a generally tapered S or sinusoidal shape in cross-section wherein the maximum radius of the duct measured from the central axis of the turbine becomes smaller along the length of the duct between the first compressor and the second compressor.

The inner gas facing wall of the duct may be the outer surface of a hub of the multi-stage compressor and the opposing outer gas facing wall may be the inner surface of the shroud of the multi-stage compressor.

Regions of the duct inner surface which are provided with a higher surface roughness than the remainder of the duct (that is regions which have not had their surface roughness modified either to increase or decrease their surface roughness—the 'un-modified' regions) may be provided with any suitable surface roughness value according to the given duct design. The inventor has established that the regions of the inner surfaces of the channel with a higher surface roughness should advantageously have an average roughness value of 3 microns $R_a$ or greater.

Similarly, regions of the duct inner surface which are provided with a lower surface roughness than the remainder of the duct (that is regions which have not had their surface roughness modified either to increase or decrease their surface roughness—the 'un-modified' regions) may be provided with any suitable surface roughness value according to the given duct design. The inventor has established that the regions of the inner surfaces of the channel with a lower surface roughness should advantageously have an average roughness value of between 0.5 and 1.6 microns $R_a$.

The increased surface roughness, which prevents the boundary separation described herein, may be achieved using a variety of manufacturing techniques (discussed below). In an alternative the surface roughness may be adapted by forming or positioning protuberances on and/or along the surface to cause the same aerodynamic disturbance that prevents the important boundary separation. For example, the regions of the inner surfaces of the channel with a higher surface roughness may be provided with protuberances (for example a projection, ridge or bulge) extending from the surface and into the channel. Thus, boundary separation can be reduced. For example, the protuberances may be in the form of chevrons distributed across the region of the channel. Such protuberances could be formed using additive manufacturing techniques.

In one arrangement the chevrons could be movable, i.e., extended/retracted in use to provide give real time adjustment of boundary separation.

Viewed from another aspect there is provided a multi-stage gas turbine engine comprising a compressor arrangement as described herein.

Viewed from another aspect there is provided a method of manufacturing a duct for a multi-stage compressor, the duct shape comprising a channel for gas flow and having an inner gas facing wall and an opposing outer gas facing wall defining the inner surfaces of the channel, the method comprising the steps of (A) forming the duct shape; and (B) machining predetermined regions of the inner surfaces of the channel to reduce the average surface roughness in said predetermined regions to an average surface roughness below the average surface roughness of the remaining inner surfaces of the channel.

As discussed above, the predetermined regions may be machined to any suitable surface roughness. For example, the regions may be machined to an average surface roughness of between 0.5 and 1.6 microns $R_a$.

Viewed from another aspect there is provided a method of manufacturing a duct for a multi-stage compressor, the duct shape comprising a channel for gas flow and having an inner gas facing wall and an opposing outer gas facing wall defining the inner surfaces of the channel, the method comprising the steps of (A) forming the duct shape; and (B) machining predetermined regions of the inner surfaces of the channel to increase the average surface roughness in said predetermined regions to an average surface roughness above the average surface roughness of the remaining inner surfaces of the channel.

As discussed above, the predetermined regions may be machined to any suitable surface roughness. For example, the regions may be machined to an average surface roughness of 3 microns $R_a$ or greater.

The machining of the surface roughness may be performed using any suitable process. Examples include a polishing process, a robot assisted polishing process, laser washing, tumbling or water jet polishing. Other processes to increase surface roughness include milling, grinding or coarse polishing.

The forming step may be performed in a number of different ways including casting or forging. The material selected for the duct may be any suitable material that can accommodate the high temperatures within the gas turbine engine. Example materials are forgings, sheet and castings of titanium, aluminium or titanium or aluminium alloys.

The forming step may also be performed using additive manufacturing techniques to create the duct shape. For example, the forming step may involve powder based additive manufacturing techniques (deposition processes) or metal wire deposition processes. Other techniques may include selective laser sintering, electron beam welding or other techniques Viewed from yet another aspect there is provided a method of manufacturing a duct for a multi-stage compressor, the duct shape comprising a channel for gas flow and having an inner gas facing wall and an opposing outer gas facing wall defining the inner surfaces of the channel, the method comprising the steps of (A) using an additive manufacture (AM) process to form the duct shape; and (B) during the AM process providing predetermined regions of the inner surfaces of the channel with a predetermined and dissimilar surface roughness.

Viewed from a still further aspect, there is provided a transition duct for a multi-stage compressor of a gas turbine engine, said duct arranged in use to communicate gas between a first and second compressor coaxially located with respect to a central axis of a gas turbine engine, wherein the duct defines a channel for gas flow and comprises an inner gas facing wall and an opposing outer gas facing wall defining the inner surfaces of the channel, and wherein regions of the inner surfaces of the channel have a predetermined and dissimilar surface roughness.

Various additive manufacturing techniques and could be used to apply the surface modifications of the present invention to an inner surface of a duct. In fact the geometries make additive manufacture particularly appropriate since complex internal geometries and surface finishes can be created without the need for access by grinding or polishing tooling.

The term additive manufacture is intended to refer to a technique where the component, the duct, is created layer by layer until the complete duct is formed. Examples of additive manufacturing technique which could conveniently be used include powder bed techniques such as electron beam welding, selective laser melting, selective laser sintering or direct metal laser sintering. Alternative technique may include wire fed processes such as electron beam forming.

Aspects of the present disclosure extend to methods of using additive manufacture for forming a duct using each of these processes above to apply the zoned surface roughness arrangement described herein.

DRAWINGS

Non-limiting examples will now be described with reference to the accompanying figures in which.

Figure 1:
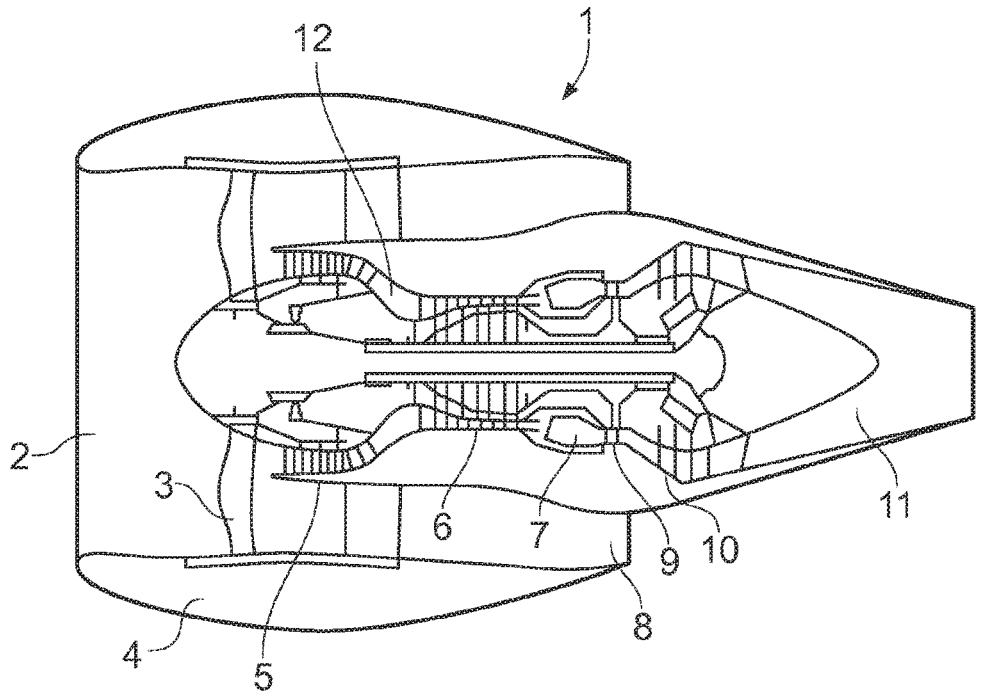
FIG. 1 shows a cross-section of a gas turbine engine incorporating a duct.

While the invention is susceptible to various modifications and alternative forms, specific embodiments are shown by way of example in the drawings and are herein described in detail. It should be understood however that drawings and detailed description attached hereto are not intended to limit the invention to the particular form disclosed but rather the invention is to cover all modifications, equivalents and alternatives falling within the spirit and scope of the claimed invention It will be recognised that the features of the aspects of the invention(s) described herein can conveniently and interchangeably be used in any suitable combination

DETAILED DESCRIPTION

FIG. 1 shows a cross-section of a gas turbine engine 1 incorporating a duct according to the invention as described in detail below.

The skilled person will understand the principal components of a gas turbine engine and their operation. In summary the engine 1 comprises an air intake 2 which permits air to flow into the engine to the fan 3 located at the upstream end of the engine. All of the components are housed within the engine nacelle 4.

The engine comprises a bypass channel downstream of the fan and a central engine core which contains the compressors, combustors and turbines. The core of the engine is formed of a first low pressure compressor 5 and a second high pressure compressor 6. This multi-stage compressor arrangement takes air from ambient pressure and temperature to high temperature and pressure. Compressed air is then communicated to the combustion chamber 7 where fuel is injected and combustion occurs.

The combustion gases are expelled from the rear of the combustions chamber 7 and impinge first on a high pressure turbine 9 and then on a second low pressure turbine 10 before leaving the rear of the engine through the core nozzle 11. Thrust from the engine is created by two gas flows: a first from the fan nozzle 8 (receiving thrust from the fan) and secondly from the exhaust gases from the core nozzle 11.

The transition duct 12 communicates compressed gas from the outlet of the low pressure compressor 5 to the inlet of the high pressure compressor 6 shown in FIG. 1.

As shown both compressors are coaxial with the central axis of the turbine. The low pressure compressor 5 has a larger outer radius (measured from the central axis of the compressor) than the outer radius of the high pressure compressor 6 because of the efficiency reasons (examples discussed above).

This requires that the duct or channel communicating air between the two compressors has a generally S or sinusoidal shape to communicate the compressed air towards the central axis of the turbine and into the high pressure turbine 6.

As discussed above, a major source of pressure loss in ducts of this type (also known in the art as core flow transition ducts) is rough surfaces that cause large friction losses. Specifically, rough surfaces on the inner surfaces of the duct (i.e. the surfaces which contain the gas and which define the gas flow channel) against which the gas flow impinges.

Efficiency losses (pressure losses) within the duct can be caused by a number of factors including:

(i) Friction of the gas flow against the channel surfaces;

(ii) Incoming wakes from the upstream components interacting with the flow in the duct; and (iii) Separation of the gas flow from the channel walls.

The present disclosure is concerned with reducing the third of these factors which has a potential to create surprising improvements in performance and reduces overall pressure loss within the duct.

Figure 2:
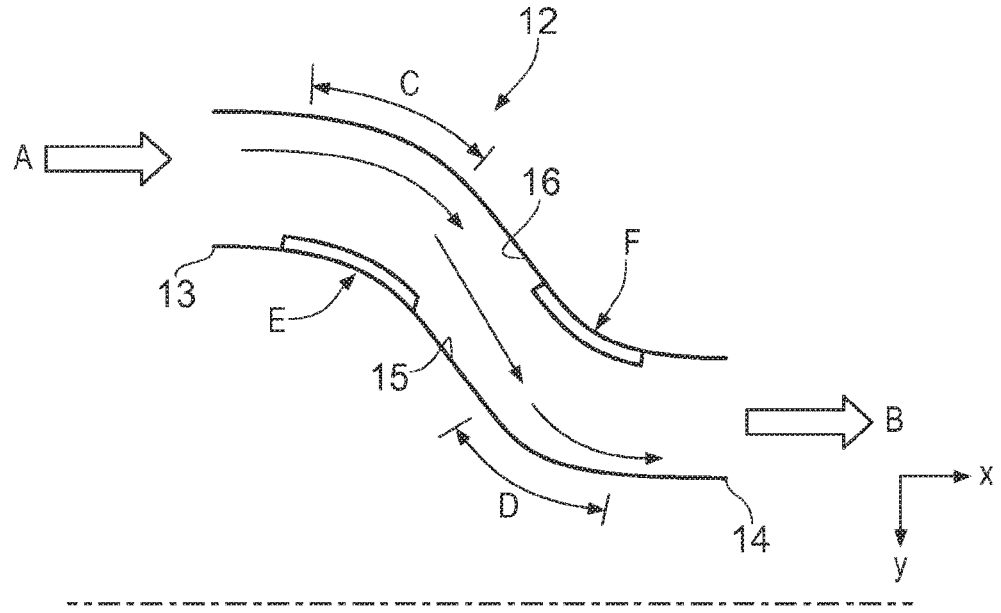
FIG. 2 shows an expanded schematic of the duct.

FIG. 2 is an enlarged schematic of the duct 12 in FIG. 1.

The arrows A and B show the gas flow into and out of the duct respective. The duct inlet 13 is connected to the outlet of the low pressure compressor 5 (not shown) and the duct outlet 14 is connected to the inlet of the high pressure compressor 6 (again not shown).

It will be recognised, with reference to the cross-section in FIG. 1, that the duct is in the form of a ring or annulus extending around the circumference of the engine core. The inner and outer walls (15, 16) of the gas flow channel contain and direct the gas flow from A to B. The schematic arrows show how the gas flows first against the first concave bend C of the duct. This first bend portion C provides the gas flow with an inwardly directed y component of movement i.e. towards the central axis of the turbine.

The gas flow then traverses the channel and impinges on the second concave bend portion D which returns the gas flow to a flow axial direction x parallel with the central axis of the gas turbine.

The present disclosure can be best understood with reference to the 4 regions shown in FIG. 2, namely the first and second concave bending portions or regions C, D and also the two opposing convex portions or regions E, F.

During operation the high speed gas flow in the duct can cause separation of the gas flow from the inner wall 15 at portion E. Separation is the detachment of the gas flow from the inner wall surface. This separation dramatically increases pressure losses through the duct. Exactly the same effect is caused at the second convex bend portion F. Again, separation of the gas flow from the inner wall 16 of the channel creates further turbulence in the gas flow increasing pressure losses further.

Figure 3:
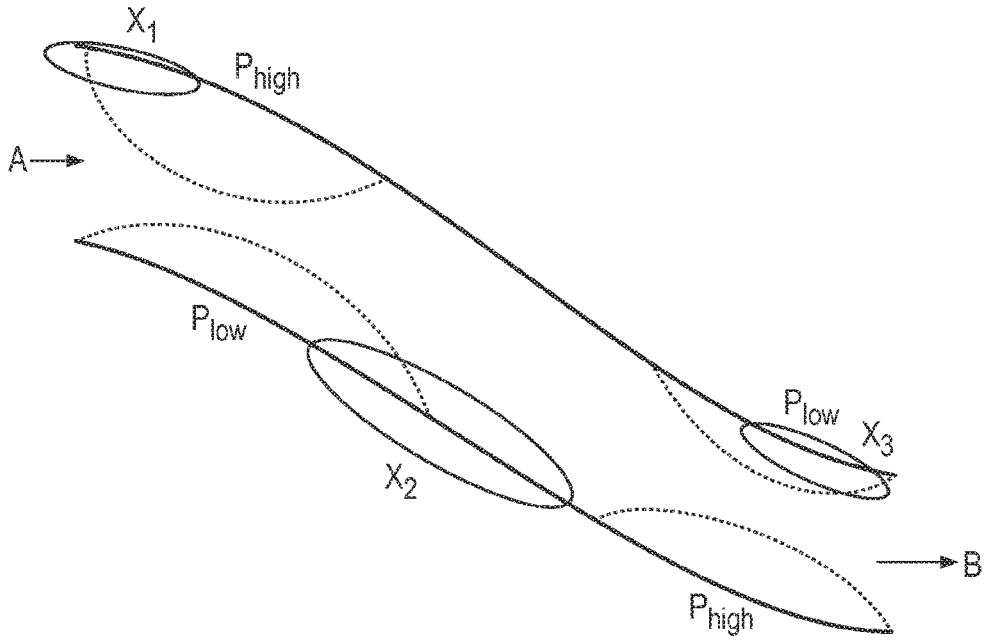
FIG. 3 shows the pressure regions within the duct.
Figure 4:
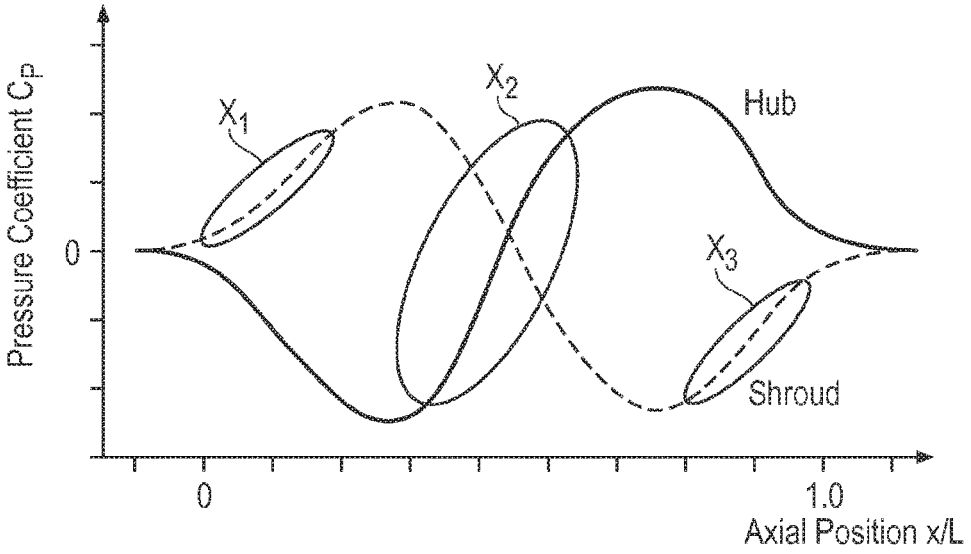
FIG. 4 shows a graph of pressure coefficient versus the axial position along the duct.

FIGS. 3 and 4 illustrate the high and low pressure zones along the axial length of the duct and a graph showing the relationship between pressure coefficient $C_p$ and the axial extension of the duct.

The flow in a compressor duct is largely controlled by the changes in pressure inside the duct. Due to the curvature of the duct, the pressure will vary in the flow direction (arrows A in FIG. 3).

There are two major design criteria:

a) low pressure loss from inlet to exit; and b) no flow separation inside the duct.

As discussed above, the second is most important since this dramatically affects the flow coming into the high pressure compressor (and separation increases loss dramatically).

Risk for separation is high in areas where the flow goes against increasing pressure (the zones marked X in FIG. 4).

Conventionally the design of the duct has a large separation margin, which leads to single focus on the pressure loss due to friction only. Therefore the duct walls are polished to reach a low surface roughness and a low friction. However, the drive towards more aggressive designs needed for geared fan architectures requires a challenge of the conventional separation margin.

The inventor has established that this can be accomplished by making sure the boundary layer next to the wall of the duct is turbulent. This in turn is achieved e.g. by having a rough surface. Convention would dictate that increasing friction within the duct would be detrimental to performance. However, although increasing friction causes a local reduction in efficiency, the overall surface area is decreased since the duct is shorter. Thus, the overall effect is positive in terms of overall duct performance.

Furthermore, and advantageously, the areas which create the most benefit from having increased roughness are also the ones hardest to access for polishing. Hence there is a potential cost reduction for production as described herein.

The exact locations of the increased surface roughness are subject to the design of the duct at hand. However, with reference to FIG. 4, the regions that benefit from increased surface roughness are related to the axial positions x/L where the pressure coefficient is rising as shown in FIG. 4. The regions X1, X2 and X3 in FIG. 4 correspond to the same labelled regions in FIG. 3.

The way the surface roughness in these regions can be adapted may be achieved in many different ways. For a given air flow speed, and a given duct geometry, there is a maximum surface roughness that can be tolerated before separation of the boundary layer occurs i.e. below this roughness threshold the surface is considered to be hydrodynamically smooth.

For example, in one embodiment the cast component may only be polished or machined and regions E and F left un-machined i.e. retain the casting surface. Alternatively, the regions E, F may be adapted to increase surface roughness, for example by grinding or another process that increased average surface roughness.

The important relationship is that the relative surface roughnesses of the regions C, D, E and F meet the following criterion:

$R_a$ of regions E and F is greater than the $R_a$ of regions C and D

Examples of surface roughnesses are:

Region C—0.5 to 1.6 microns $R_a$

Region D—0.5 to 1.6 microns $R_a$

Region E—3 microns $R_a$ or greater

Region F—3 microns $R_a$ or greater

Where chevrons are used the chevrons may extend from the inner surface by 0.5 mm to 1.5 mm.

The surface finishes described above can be created using a variety of different finishing techniques. For example, predetermined surface roughnesses may be created using one of the following techniques which are known in the manufacturing field:

Robot assisted polishing

Laser washing

Tumble or barrel finishing

Water jet polishing; amongst others.

Figure 5A:
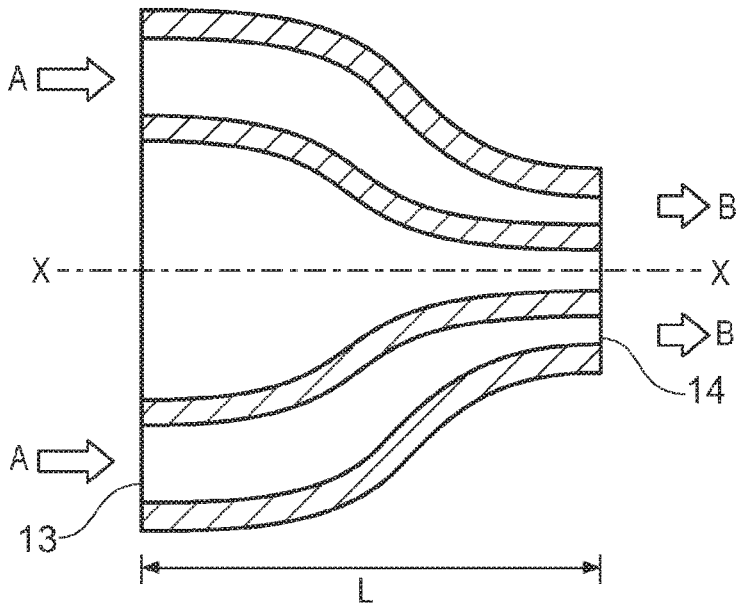
FIG. 5A shows a cross-section view of the duct profile illustrating the geometry of the duct.
Figure 5B:
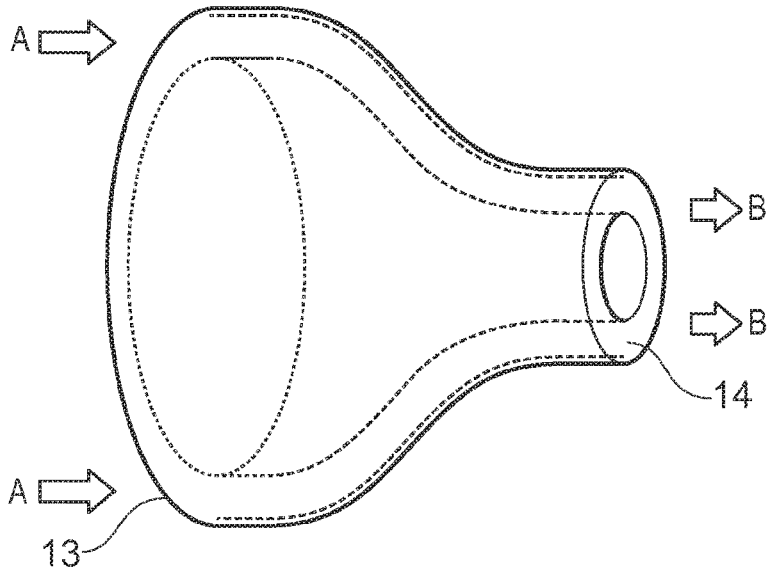
FIG. 5B shows a perspective view of the duct profile illustrating the geometry of the duct.

FIGS. 5A and 5B clarify the geometry of the duct in isolation. The duct provides a cylindrical and annular conduit having an annular inlet 13 and an annular outlet 14. FIG. 5A shows a cross-section through the entire duct (as opposed to just an upper cross-section shown in FIG. 2). A shown the duct is located about a central axis X which is arranged in use to align with the central axis of the gas turbine engine. The inlet 13 is in the form of an annular ring defining an inlet to the flow passage towards the outlet 14, again an annular ring. The flow path tapers as described above to direct compressed air from the outlet of the first compressor to the inlet of the second compressor.

FIG. 5B shows a perspective view of the duct with the outlet 14 being visible and the inlet shown with hidden lines. It will be recognised that the precise geometry of the taper between inlet and outlet and also the overall length L of the duct will vary depending on the design of the particular gas turbine engine to which the duct will be applied.

The skilled person will recognise from the description and Figures that the inner surfaces of the duct have, in effect, 4 regions of modified surface roughness that extend as circular regions (rings) around the air channel of the duct (either on the inner gas facing wall or on the outer gas facing wall). The length of each 'ring'—that is the distance the ring extends along the surface of the—duct will be determined by the aerodynamic profile of the duct, for example how sharply the duct changes the air flow path (amongst other features).

Viewed along the length of the duct, measured from the inlet to the outlet, 4 distinct rings or discs of modified surface roughness can be identified. Specifically, there are at least 2 regions provided with a modified surface roughness on the outer gas facing wall, and at least 2 regions provided with a modified surface roughness on the inner gas facing wall.

Measured from an inlet to an outlet of the duct, the first of said at least 2 regions on the outer gas facing wall has a lower surface roughness than the second region.

Conversely, measured from an inlet to an outlet of the duct, the first of said at least 2 regions on the inner gas facing wall has a higher surface roughness than the second region.

The invention claimed is:

1. An apparatus comprising a multi-stage compressor, comprising:

a first and second compressor coaxially located with respect to a central axis of a gas turbine engine, wherein an outlet of the first compressor is in fluid communication with an inlet of the second compressor through a duct, the duct defining a channel for gas flow and comprising an inner gas facing wall and an opposing outer gas facing wall defining the inner surfaces of the channel, and wherein regions of the inner surfaces of the channel have a predetermined and dissimilar surface roughness, and wherein at least one region of the inner surface of the channel against which flowing gas impinges is provided with a surface roughness which is lower than regions of the inner surfaces against which flow gas does not impinge.

2. The apparatus of claim 1, wherein regions of the inner surfaces which in use experience lower gas static pressure are provided with a surface roughness which is higher than the remaining inner surfaces of the channel.

3. The apparatus of claim 1, wherein the duct is in the form of a ring coaxially located with respect to a central axis of the compressor which tapers from a first maximum radius measured from the central axis of the compressor to a second smaller radius measured from the central axis of the compressor.

4. The apparatus of claim 1, wherein the duct is in the form of a ring or annulus coaxial with the central axis of the compressor, the circumferential perimeter of the ring or annulus having a generally tapered S or sinusoidal shape in cross-section, wherein the maximum radius of the duct measured from the central axis of the turbine tapers along the length of the duct between the first compressor and the second compressor.

5. The apparatus of claim 1, wherein the inner gas facing wall is the outer surface of a hub of the multi-stage compressor and the opposing outer gas facing wall is the inner surface of the shroud of the multi-stage compressor.

6. The apparatus of claim 1, wherein the regions of the inner surfaces of the channel with a higher surface roughness have an average roughness of 3 microns $R_a$ or greater.

7. The apparatus of claim 1, wherein the regions of the inner surfaces of the channel with a lower surface roughness have an average roughness of between 0.5 and 1.6 microns $R_a$.

8. The apparatus of claim 1, wherein the regions of the inner surfaces of the channel with a higher surface roughness are provided with protuberances extending from the surface and into the channel.

9. The apparatus of claim 8, wherein the protuberances are in the form of chevrons distributed across the region of the channel.

10. The apparatus of claim 1, further comprising a multi-stage gas turbine engine in which the multi-stage compressor is included.

11. A transition duct for a multi-stage compressor of a gas turbine engine, said duct arranged in use to communicate gas between a first and second compressor coaxially located with respect to a central axis of a gas turbine engine, wherein the duct defines a channel for gas flow and comprises an inner gas facing wall and an opposing outer gas facing wall defining the inner surfaces of the channel, and wherein regions of the inner surfaces of the channel have a predetermined and dissimilar surface roughness, and wherein at least one region of the inner surface of the channel against which flowing gas impinges is provided with a surface roughness which is lower than regions of the inner surfaces against which flow gas does not impinge.

12. The transition duct of claim 11, wherein there are at least two regions provided with a modified surface roughness on the outer gas facing wall, and at least two regions provided with a modified surface roughness on the inner gas facing wall.

13. The transition duct of claim 12, wherein measured from an inlet to an outlet of the duct, the first of said at least 2 regions on the outer gas facing wall has a lower surface roughness than the second region.

14. The transition duct of claim 12, wherein measured from an inlet to an outlet of the duct, the first of said at least two regions on the inner gas facing wall has a higher surface roughness than the second region.

* * * * *